United States Patent [19]

Vennix et al.

[11] 4,323,817

[45] Apr. 6, 1982

[54] COLOR DISPLAY TUBE

[75] Inventors: Johannus A. Vennix; Cornelis Stapel, both of Eindhoven, Netherlands

[73] Assignee: U.S. Philips Corporation, New York, N.Y.

[21] Appl. No.: 102,202

[22] Filed: Dec. 10, 1979

[30] Foreign Application Priority Data

Jan. 26, 1979 [NL] Netherlands ..... 7900623

[51] Int. Cl.[3] ..... H01J 29/70

[52] U.S. Cl. ..... 313/440; 335/210; 358/248

[58] Field of Search ..... 313/440, 477 R, 482, 313/433; 358/248, 249; 335/210; 315/299

[56] References Cited

U.S. PATENT DOCUMENTS 3,697,909 10/1972 Christensen et al. ..... 358/248

4,110,793 8/1978 Tajiri ..... 358/248

4,117,516 9/1978 Yasuhara ..... 358/248

4,130,836 12/1978 Kornaker ..... 358/248

FOREIGN PATENT DOCUMENTS 54-28070 9/1979 Japan ..... 313/482

*Primary Examiner*—Stanley T. Krawczewicz

*Attorney, Agent, or Firm*—Robert J. Kraus

[57] ABSTRACT

Reference studs on the outside of a cone of a color display tube, against which a system of deflection coils is to be placed, are manufactured from non-ferromagnetic material. The side of each stud which is secured against the cone consists of stainless steel, titanium or a titanium alloy to prevent interference with deflection fields generated by the deflection coils. The studs are secured to the cone by a glue which permits removal if necessary.

9 Claims, 10 Drawing Figures

COLOR DISPLAY TUBE

BACKGROUND OF THE INVENTION

The invention relates to a colour display tube comprising a glass envelope consisting of a display window, a cone and a neck, which envelope is provided, in the neck-cone transition part, with a number of reference studs on the outside of the envelope against which the system of deflection coils is placed.

Such a colour display tube is known from the article "30 AX-Self-aligning 110° in-line colour T.V. display" in IEEE Transactions on Consumers Electronics, vol. CE-24, No. 3, August 1978, pp. 481-7. The positioning of the system of deflection coils relative to the glass envelope is obtained in the colour display tube described here by means of three studs on the cone which cooperate with studs on the inside of the system of deflection coils. These studs on the cone fix three reference points which, together with the clamping ring of the system of deflection coils around the neck, fix the common axis of the envelope and the system of deflection coils. In the production process of colour display tubes it has proved difficult to glue studs to the glass envelope. Because the studs form the reference points for the system of deflection coils and in each tube have a predetermined thickness, the studs should not work loose because in that case the reference points for the system of deflection coils would be lost. In the case of a wrong choice of the thickness of the stud or in the case of a choice of another type of system of deflection coils the studs must be easily removable from the tube to enable replacement by other studs having the correct thickness.

SUMMARY OF THE INVENTION

It is therefore an object of the invention to provide a colour display tube which is provided with reference studs which can be very rigidly secured to the glass of the envelope and which, if desired, can be easily removed. Also, the studs should not interfere with the deflection fields which are generated by the system of deflection coils.

A colour display tube of the kind described in the opening paragraph is characterized according to the invention in that the reference studs consist of non-ferromagnetic material and at least the side of the studs which is secured against the glass envelope consists of stainless steel, titanium or a titanium alloy.

Stainless steel, titanium or a titanium alloy are non-ferromagnetic so that these materials will not interfere with the fields generated by the system of deflection coils. Stainless steel, titanium and titanium alloys also have high electrical resistivities $\rho$, so that no large eddy currents will be produced therein which would cause interference with the deflection fields of the system of deflection coils. Stainless steel can be rigidly secured to the glass of the envelope by means of a permanently flexible type of glue (for example, a glue known by the trade name "Degussa Agomet F220"). Titanium and titanium alloys have coefficients of expansion which are equal to or substantially equal to that of the glass envelope so that a curing type of glue may be used for a rigid connection of the studs to the envelope (for example, a glue known by the tradename "Loctite 317"). Studs which at least partially comprising stainless steel, titanium or a titanium alloy can be easily removed from the glass of the envelope, if so desired, by means of high frequency heating.

The studs may be manufactured entirely of stainless steel, titanium or a titanium alloy. It is also possible, however, for the studs to comprise a synthetic resin portion which is secured to a plate-shaped portion consisting of stainless steel, titanium or a titanium alloy. This provides an inexpensive stud which can be easily processed.

Because it is difficult to glue the synthetic resin portion of the plate-shaped portion, a connection of these portions together is preferably obtained by means of fingers extending into the synthetic resin portion from the edge of the plate-shaped portion consisting of stainless steel, titanium or a titanium alloy.

Another embodiment of the invention is that in which a piece of gauze is spotwelded against the plateshaped portion consisting of titanium or a titanium alloy and is embedded in the synthetic resin portion. This also provides a very rigid connection.

Yet another embodiment of the invention is one in which the edge of the plate-shaped portion consisting of stainless steel, titanium or a titanium alloy is bent away at least partly from the glass surface of the envelope and extends into a groove provided in the synthetic resin portion so that a detachable connection if formed. The advantage of this embodiment is that the portion consisting of stainless steel, titanium or a titanium alloy can be glued to the envelope without the synthetic resin portion, after which a synthetic resin portion is detatchably connected thereto.

An adjustable stud is obtained if the portion consisting of stainless steel, titanium or a titanium alloy consists of a first portion which is attached to the envelope and which is connected, by means of plastically deformable strips extending from the portion attached envelope, to a second portion which forms the engaging surface for the system of deflection coils.

A titanium alloy which gives very good satisfaction and which can readily be processed consists, according to the invention, of 90% by weight of titanium, 6% by weight of aluminium and 4% by weight of vanadium. (This alloy is known by the tradename "Contimet ALV 64").

BRIEF DESCRIPTION OF THE DRAWING

The invention will now be described in greater detail, by way of example, with reference to the accompanying drawing in which.

DESCRIPTION OF THE PREFERRED EMBODIMENTS

Figure 1:
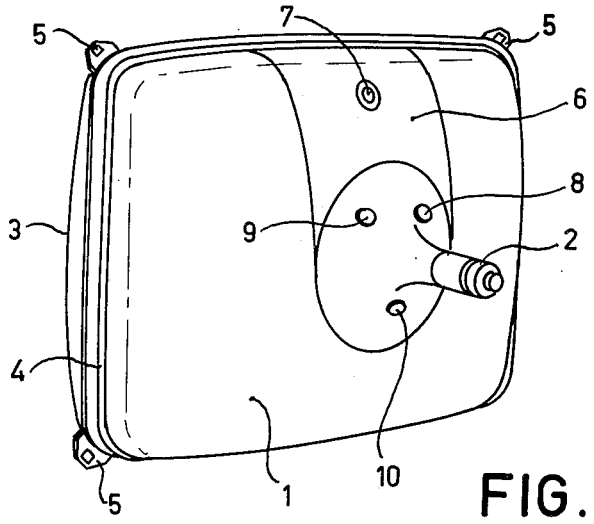
FIG. 1 is a perspective view of a colour display tube according to the invention.

FIG. 1 is an elevation of a colour display tube according to the invention. The glass envelope of the tube consists of a cone 1, a neck 2 and a display window 3 which is only partly visible. A reinforcement band 4 having suspension lugs 5 in the corner points is provided around the display window-cone transition part of the envelope. On its outside the envelope is covered with an electrically conductive layer 6. The cone 1 has a high voltage leadthrough 7 for applying a high potential to the electrically conductive inner coating of the cone (not visible). Three studs 8, 9 and 10 forming the reference points for the system of deflection coils are secured to the neck-cone transition part. As a result of inaccuracies in manufacturing the tubes, differences in dimensions of the parts of the envelope of each tube and differences in the positions of the various electron-optical elements occur. Therefore, the location of the reference points is fixed for each tube by the studs 8, 9 and 10. These studs may differ in thickness for each tube depending on the differences in dimensions and positions and depending on the locations of the studs on the envelope. After providing the studs it is possible to accurately place manufactured systems of deflection coils against the studs on the envelope without any further position adjustment being necessary. Because the studs prepare the display tube for rapid positioning of the system of deflection coils, these studs should be well fixed to the envelope. The studs should not work loose as a result of differences in expansion between the material of the stud, the glass of the envelope and the system of deflection coils. For that purpose, according to the invention, the studs, at least on the side with which they engage the glass of the envelope, are manufactured from stainless steel, titanium or a titanium alloy. Stainless steel has an average coefficient of expansion of approximately $17.10^{-6}$/°C. between 0°–100° C. Because this is much larger than the coefficient of expansion of the glass (approximately $9.5.10^{-6}$/°C.) of the envelope, a permanently elastic glue should be used. The electric resistivity of stainless steel is approximately 70 to 80μΩ/cm, which is sufficient to minimize eddy currents.

Suitable stainless steels include N286 steel which consists mainly of 17–19% by weight of Cr, 11–14% by weight of Ni and the remainder Fe, and N544 steel which consists mainly of 24–26% by weight of Cr, 19–23% by weight of Ni and less than 57% by weight of Fe. These types of stainless steel are not ferromagnetic. Titanium or titanium alloys have an average coefficient of expansion of approximately $9.5.10^{-6}$/°C. between 0° and 100° C. The electric resistivity of titanium and titanium alloys is determined by contaminations, alloying elements, deformation state and temperature.

For pure titanium the resistivity $\rho$ at room temperature is approximately 45μΩ/cm and at 100° C. approximately 60μΩ/cm. The electrical resistivity is increased by the addition of other materials. A few useful alloys are recorded in the following table. The number behind the alloying element denotes the average percentage by weight of said element in the alloy, the remainder is titanium.

| No. | Alloy | $\rho$(in μ Ω . cm) |
|---|---|---|
| 1. | Ti Al 8 Mo 1 V 1 | 200 |
| 2. | Ti Al 6 Zr 4 Sn 2 Mo 2 | 190 |
| 3. | Ti Al 7 Mo 4 | 175 |
| 4. | Ti Al 6 V 4 | 170 |
| 5. | Ti Al 5 Sn 2½ | 160–170 |

Figure 2:
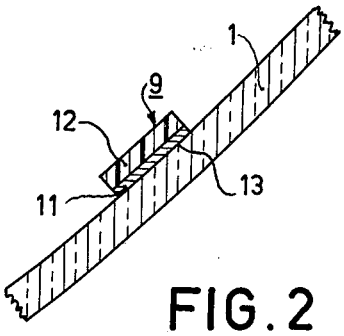
FIG. 2 is a diagrammatic sectional view of a stud connected to the glass envelope.

FIG. 2 is a sectional view of the connection of the stud 9 to the cone 1. The stud consists of a titanium plate 11 to which a synthetic resin portion 12 (for example of noryl) is secured. Titanium has approximately the same coefficient of expansion as the glass of the envelope and can therefore be readily connected by means of a curing glue at 13.

Figure 3:
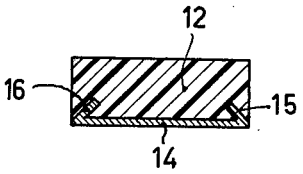
FIGS. 3 to 8 show how the portion consisting of stainless steel, titanium or a titanium alloy can be secured on a synthetic resin portion.
Figure 4:
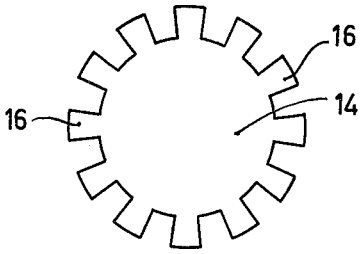

FIGS. 3 and 4 show how the titanium portion 14 can be connected to the synthetic resin portion 12 without the use of a glued joint. FIG. 3 is a sectional view of the stud and FIG. 4 is an elevation of a developed plate-shaped portion. The lugs 16 of portion 14 are bent and extend into the synthetic resin portion at 15.

Figure 5:
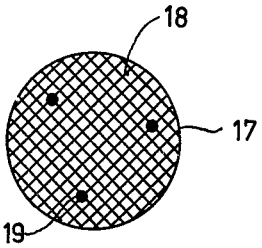

A second way of connecting a titanium portion 17 to a synthetic resin portion is shown in FIG. 5. This titanium portion has a gauze 18 which is secured to the portion 17 by means of spot welds 19, said gauze being embedded in the synthetic resin portion.

Figure 6:
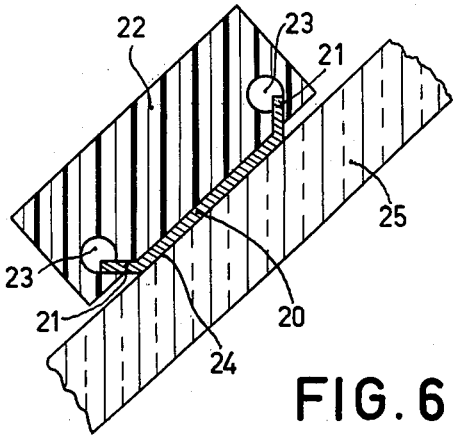
Figure 7:
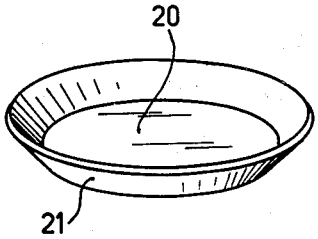
Figure 8:
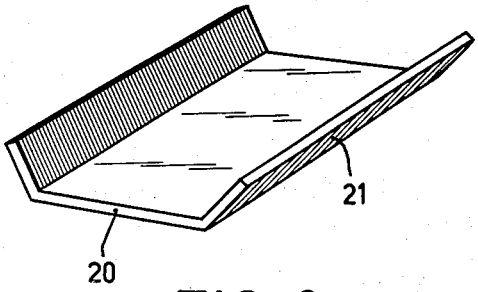

FIG. 6 shows a stud for a display tube according to the invention comprising a base portion 20 of stainless steel which is secured to the glass of the envelope 25 by means of an elastic glued joint 24. The edge of the base portion 21 is bent away from the glass and extends into the synthetic resin portion 22 which purpose has grooves 23 for receiving the edge. If the base portion 20 has the shape shown in FIG. 7, the portion 22 is pushed over the edge 21. In that case the synthetic resin portion should be more or less elastic. If the base portion 20 has a shape as shown in FIG. 8, the synthetic resin portion 22 can be slid over the edge 21. These latter two stud constructions are detachable.

Figure 9:
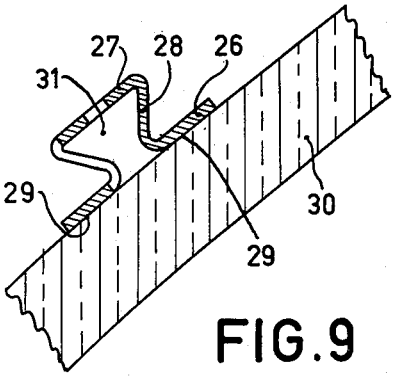
FIGS. 9 and 10 are a cross-sectional view and an elevation of an adjustable stud.
Figure 10:
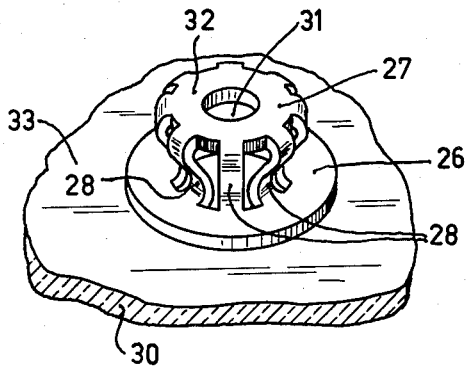

FIGS. 9 and 10 show an adjustable stud for a colour display tube according to the invention. In the example this stud consists of pure titanium and comprises a first portion 26 which is secured to the glass 30 of the envelope by means of a curing glued joint 29 and a second portion 27 which will serve as a reference surface for the system of deflection coils. The first portion 26 and the second portion 27 are connected together by means of flexible strips 28. By bending the strips 28, the desired thickness of the stud is obtained. The stud thickness is the distance between the surface 32 of portion 27 and the glass surface 33 below the stud. If desired, the space 31 can be filled with a curing synthetic resin to increase the rigidity of the stud.

What is claimed is:

1. A colour display tube comprising a glass envelope including a display window, a cone and a neck, which envelope is provided, in the neck-cone transition part, with a number of reference studs on the outside of the envelope to adapt the tube for placement of a system of deflection coils thereon, characterized in that each reference stud consists of non-ferromagnetic material, and at least the side of the stud which is secured against the glass envelope consists of stainless steel, titanium or a titanium alloy.

2. A colour display tube as in claim 1, characterized in that each stud comprises a synthetic resin portion which is secured to a plate-shaped portion of the stud consisting of stainless steel, titanium or a titanium alloy.

3. A colour display tube as in claim 2, characterized in that fingers extend into the synthetic resin portion from the edge of the plate-shaped portion consisting of stainless steel, titanium or a titanium alloy.

4. A colour display tube as in claim 2, characterized in that the edge of the plate-shaped portion consisting of stainless steel, titanium or a titanium alloy is bent away at least partly from the glass surface of the envelope and extends in a groove provided in the synthetic resin portion so that a detachable connection is formed.

5. A colour display tube as in claim 2, characterized in that a gauze which is embedded in the synthetic resin portion is welded against the plate-shaped portion consisting of stainless steel, titanium or a titanium alloy.

6. A colour display tube as in claim 1, characterized in that the portion of each stud consisting of stainless steel, titanium or a titanium alloy comprises a first portion which is connected against the envelope and which is secured to a second portion, forming a reference surface for the system of deflection coils, by means of deformable strips extending from the envelope.

7. A colour display tube as in any of the preceding claims, characterized in that the titanium alloy comprises substantially 90% by weight of Ti, 6% by weight of Al and 4% by weight of V.

8. A colour display tube as in any of the claims 1 to 6, characterized in that the stainless steel comprises substantially 17–19% by weight of Cr, 11–14% by weight of Ni and the remainder Fe.

9. A colour display tube as in any of the claims 1 to 6, characterized in that the stainless steel comprises substantially 24–26% by weight of Cr, 19–23% by weight of Ni and less than 57% by weight of Fe.

* * * * *